United States Patent [19]

Hsu et al.

[11] Patent Number: 4,818,632

[45] **Date of Patent: * Apr. 4, 1989**

[54] PLATED STRUCTURE EXHIBITING LOW HYDROGEN EMBRITTLEMENT

[75] Inventors: Grace F. Hsu, Seattle; Richard C. Colonel, Renton, both of Wash.

[73] Assignee: The Boeing Company, Seattle, Wash.

[ * ] Notice: The portion of the term of this patent subsequent to Aug. 23, 2005 has been disclaimed.

[21] Appl. No.: 773,504

[22] Filed: Sep. 4, 1985

Related U.S. Application Data

[63] Continuation of Ser. No. 671,053, Nov. 13, 1984, abandoned, which is a continuation of Ser. No. 444,243, Sep. 30, 1982, abandoned.

[51] Int. Cl.[4] ..... B23B 3/26

[52] U.S. Cl. ..... 428/613; 428/658; 428/659; 428/687; 428/935

[58] Field of Search ..... 428/613, 686, 659, 658, 428/679, 680, 687, 935; 73/86, 87; 204/43 R, 43 T, 50 R, 37 R

[56] References Cited

U.S. PATENT DOCUMENTS

| | | | |
|---|---|---|---|
| 2,534,911 | 12/1950 | Kasper | 204/37 R |
| 2,711,389 | 6/1955 | Beach et al. | 204/37 R |
| 3,055,087 | 9/1962 | Fink | 428/613 |
| 3,297,416 | 1/1967 | Ransom et al. | 428/613 |
| 3,582,480 | 6/1971 | Chorne | 204/37 R |
| 3,691,027 | 9/1972 | Hartford | 204/29 |
| 4,104,133 | 8/1978 | Brannan et al. | 204/43 T |
| 4,120,994 | 10/1978 | Inoue | 428/613 |
| 4,285,782 | 8/1981 | Waldrop | 204/40 |
| 4,388,160 | 6/1983 | Rynne | 204/38 R |

OTHER PUBLICATIONS

"Metallographic Methods", Knechtel et al., *Metals Handbook,* 8th ed., vol. 8, American Society for Metals, (Ohio, U.S.A.), 1973, pp. 1–14, 79.

"Hydrogen in Cadmium Plating", Nityanandan et al., *Metal Finishing,* Oct. 1972, pp. 49–52, (particularly p. 52, vol. 2).

"Technology of Electrodeposition", Vayramyam et al., 1961, pp. 292–294.

"AES Research Project 41: Plating on Anodized Aluminum", Lashmore, D. S., *Plating & Surface Finishing,* Apr. 1981, pp. 48–51.

"Composition Control and Microstructure of Electrodeposited Nickel–Cobalt Alloys", Walter, R. J., *Plating & Surface Finishing,* Jul. 1980, pp.46–50.

"Low–Temperature Recrystallization Kinetics in Nickel Electrodeposits", Katz et al., *Plating & Surface Finishing,* pp. 44–49, Nov. 1980.

"High–Speed Electroplating", Safranek, W. H., *Plating & Surface Finishing,* Apr. 1981, pp. 48, 52.

"Electroplating with Heat–Resistant, Sulfur–Hardened Nickel", Wearmouth et al., *Plating & Surface Finishing,* Oct. 1979, pp. 53–57.

"Performance of Fluoborate Cadmium Deposited Under Various Plating Conditions", Altura et al., *Plating & Surface Finishing,* Sep. 1974, pp. 850–853.

"Properties of Electroless Nickel–Molybdenum Alloys", Mallory, G. O., *Plating & Surface Finishing,* Jun. 1976, pp.34–40.

"How to Save Nickel and Yet Maintain Rating Quality", Davies, G. R., *Electroplating and Metal Finishing,* Jan. 1968, pp. 3 and 6.

*Primary Examiner*—John J. Zimmerman

*Attorney, Agent, or Firm*—Christensen, O'Connor, Johnson & Kindness

[57] ABSTRACT

A coated metallic article, such as a high strength steel, that exhibits low hydrogen embrittlement carries an electrodeposited coating having a microstructure characterized by a plurality of interconnected escape channels that extend from the coating-substrate interface to the surface of the coating. Determining the presence of the escape channels as well as other microstructural features enables one to readily monitor and control plating processes to assure the production of articles that exhibit low hydrogen embrittlement. Low hydrogen embrittlement characteristics are also linked to the amount of residual hydrogen in the substrate after plating and subsequent heat treatment.

10 Claims, 18 Drawing Sheets

PLATED STRUCTURE EXHIBITING LOW HYDROGEN EMBRITTLEMENT

This application is a continuation application based on prior copending application Ser. No. 671,053, filed Nov. 13, 1984, now abandoned, which in turn is a continuation application based on prior copending application Ser. No. 444,243, filed Sept. 30, 1982, now abandoned.

BACKGROUND OF THE INVENTION

The present invention relates to coated metallic articles exhibiting low hydrogen embrittlement, in addition to such articles that exhibit high corrosion resistance, and most particularly to metallic articles in which such coatings are created by electrodeposition techniques.

Steel, and especially high strength steel, is subject to delayed, brittle failures at relatively low stresses. Such failures have been attributed to the presence of hydrogen in the steel microstructure. The hydrogen can be introduced to the structure by reaction with water or with an acid, or by cathodically discharging hydrogen at the surface of the steel. Most high strength steels have corrosion resistant metallic coatings that are applied by electroplating techniques. Because these techniques are less than 100 percent efficient, hydrogen is usually discharged onto the steel surface along with the corrosion resistant coating. In order to minimize embrittlement caused by the presence of excess hydrogen, the quantity of hydrogen deposited throughout the coated article must be carefully monitored and controlled and, if necessary, altered to produce an article that exhibits low hydrogen embrittlement.

Currently, cadmium-titanium alloys are electroplated onto high strength steels under carefully controlled conditions to produce a steel product that is corrosion resistant. The resulting plated product is then heated at elevated temperatures to drive off hydrogen and achieve a structurally acceptable product. It is believed that the porosity of the electroplated cadmium-titanium alloy is the key to the removal of the hydrogen during this heat treatment. However, the cadmium-titanium plating bath is very sensitive to contamination. When the plating bath is contaminated, the resulting product is much more susceptible to embrittlement because the coating porosity is affected. Additionally, the concentration of the various components in the cadmium-titanium plating bath must be carefully controlled within very precise ranges to achieve acceptable hydrogen embrittlement and corrosion resistance characteristics at the same time. Moreover, expensive waste treatment must be performed on the spent plating bath before the components of the bath can be safely discharged into the sewage system.

As a consequence, alternatives to the cadium-titanium plating process have been sought that will provide low corrosion and low hydrogen embrittlement characteristics and be less expensive as well as easier to control. Zinc-nickel alloys are known to provide corrosion resistant electrodeposited coatings. Zinc-nickel alloys have also been employed where high speed plating processes are used. High speed plating is not satisfactory for rack plating of larger metal parts. Prior attempts at plating zinc-nickel alloy at low current densities have led to pitted and spongy deposits that do not provide good corrosion resistance. Moreover, prior attempts to produce a zinc-nickel corrosion resistant coating has led to a relatively high degree of hydrogen embrittlement in plated high strength steel parts to which the coating has been applied. Although prior work with zinc-nickel plating baths had not successfully produced a zinc-nickel coating that would provide both low hydrogen embrittlement and acceptable corrosion resistanct characteristics, the attractiveness and ease with which zinc-nickel baths could be controlled and adjusted resulted in further research. As a result of this research, a method for plating a zinc-nickel coating that would achieve both low hydrogen embrittlement and high corrosion resistance characteristics was developed. This process is disclosed in prior copending application Ser. No. 348,107, filed Dec. 28, 1981, now abandoned, entitled Zinc-Nickel Electroplated Article and Method for Producing the Same. The process disclosed and claimed in that application requires that the zinc-nickel coating be electrodeposited in the presence of a soluble ammonium salt and other additives.

SUMMARY OF THE INVENTION

As an outgrowth of the work disclosed in the prior copending application relating to the zinc-nickel coating, similarities were observed in the microstructure of certain zinc-nickel coatings that yielded the desired product exhibiting low hydrogen embrittlement. At the same time, the zinc-nickel coatings on the articles that did not exhibit low hydrogen embrittlement had a microstructure that was different from the coating on the articles exhibiting low hydrogen embrittlement characteristics. It is believed that these structural characteristics are common to metallic coatings, not only of a zinc-nickel alloy, but to other metallic coating compositions as well. The present invention in its broadest aspects therefore comprises a coated metal article exhibiting low hydrogen embrittlement, which comprises a metal substrate and a metallic coating on the substrate having a microstructure characterized by a plurality of microscopic interconnected escape channels that allow hydrogen to escape from the surface of the metal substrate during electrodeposition and subsequent processing. When these interconnected escape channels are present in the metallic coating, the coated article will exhibit low hydrogen embrittlement. The microstructure of the coating on an article exhibiting low hydrogen embrittlement in accordance with the present invention can also be characterized by a fine grained microstructure when that microstructure is viewed in fractured cross section. The fractured cross section can further be characterized by cleavage fracture and a layered microstructure. Although all of these characteristics need not be present in a coating to produce an article having low hydrogen embrittlement, the presence of these characteristics confirm the low hydrogen embrittlement characteristics of the article. As will be described in more detail below, there are additional characteristics by which the microstructure of the coating on a low hydrogen embrittlement article can be defined.

In the same vein, knowledge of the structure of the coating on an article that exhibits low hydrogen embrittlement characteristics can also serve as a valuable tool for determining whether a given produce plated in accordance with, for example, the process disclosed in the prior copending application or other plating processes, will exhibit low hydrogen embrittlement characteristics. By merely sampling at appropriate intervals articles being plated and observing their microstructure, one can readily tell whether or not the plating technique is operation to produce a low hydrogen embrittlement article. Thus, the invention also provides a method for monitoring a plating process and assuring that the metallic coating produced thereby will yield a product that will exhibit low hydrogen embrittlement characteristics. This method includes the steps of preparing a cross-sectional specimen of the coated article, magnifying the cross section, and determining from the magnified cross section the presence of a plurality of interconnected escape channels in the microstructure of the coating. The presence of other microstructural characteristics can also enhance the determination. These characteristics include the presence in a fractured cross section of a fine grained microstructure, cleavage fracture, and a layered microstructure. Additional characteristics that will also supplement the determination can also be gleaned from polished and polished and etched cross sections of the coating.

BRIEF DESCRIPTIONS OF THE DRAWINGS

A better understanding of the invention will be derived by reading the ensuing specification in conjunction with accompanying figures. All of the figures herein are photomicrographs of the surface and cross sections of various metallic coatings and the substrates upon which they are plated. These photomicrographs will be identified and discussed in more detail in conjunction with the remaining portion specification.

DETAILED DESCRIPTION OF THE INVENTION

Figure 1:
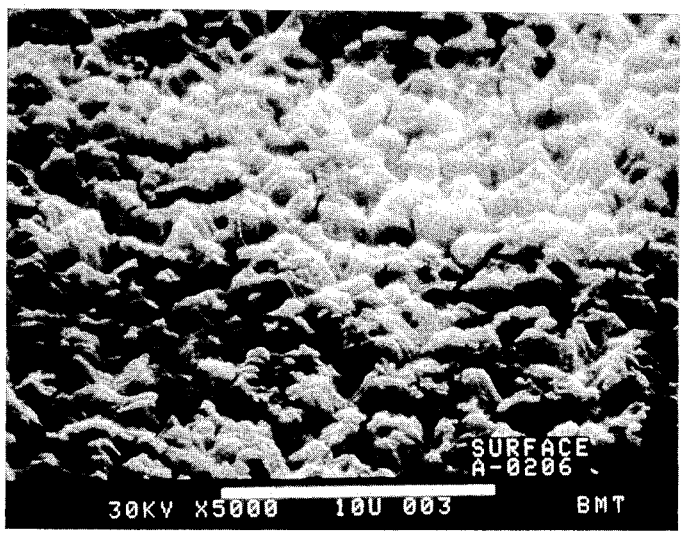
Figure 2:
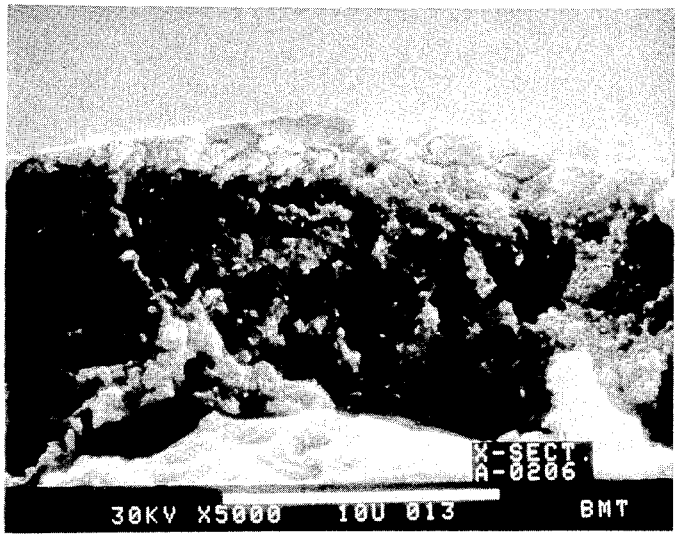
Figure 3:
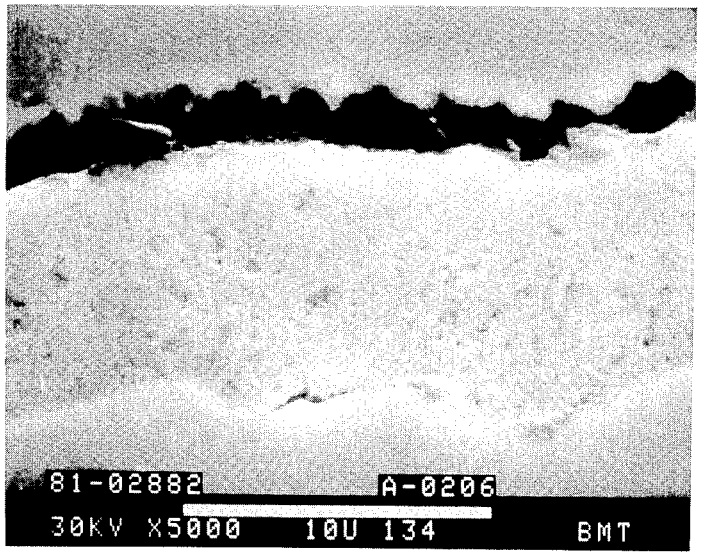
Figure 4:
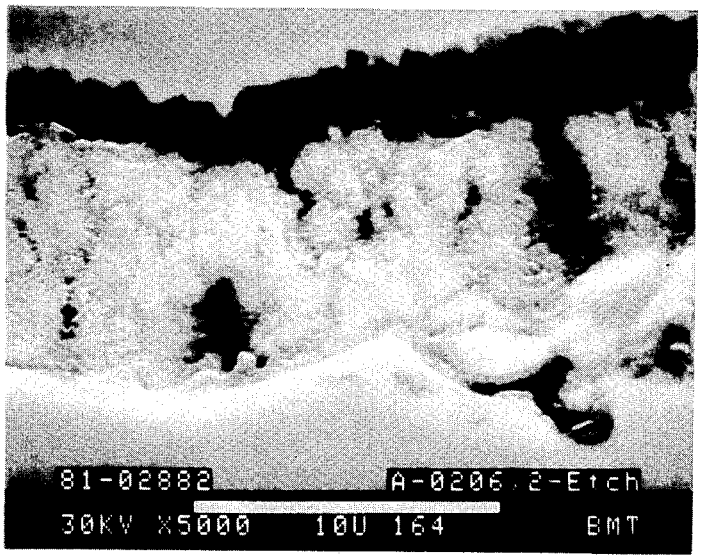

The present invention provides a metal article that exhibits low hydrogen embrittlement. The article is characterized by a metallic coating that has a unique microstructure that enables the article to exhibit low hydrogen embrittlement. The metallic coating can be produced by carefully controlled electrodeposition of a variety of materials including an alloy of zinc and nickel, cadmium, and an alloy of cadmium and titantium. The coated article is then heat treated at an elevated temperature to expel residual hydrogen trapped in both the substrate and the coating out through the coating.

The microstructure of the coating is viewed by preparing a fractured cross-section, a polished cross section, and/or a polished and chemically etched cross section of the coating. These cross-sectional specimens are prepared in accordance with conventional procedures. The cross sections are oriented generally perpendicular to the surface of the coating. The specimens are magnified and viewed to ascertain or determine the presence or absence of certain distinguishing microstructural characteristics. While there is no lower limit to the extent of magnification required in accordance with the present invention, the magnification must be of sufficient power to make the distinguishing features discussed below clearly discernible. It is preferred that the minimum magnification be on the order of 400 times the original size. Certain characteristics are best viewed in magnifications up to 5000 times or more the original size or greater.

The most important microstructural characteristic of the metal coating of the present invention is the presence of microscopic interconnected escape channels in the coating. These escape channels extend from the coating-substrate interface continuously up to the surface of the coating itself. The escape channels allow hydrogen that is present in or near the substrate to diffuse or otherwise pass through the coating during the heat treatment of the metal article after electrodeposition. Not only do the escape channels extend continuously from the substrate to the outer surface of the coating, but they are also interconnected in the lateral direction, providing a multitude of escape paths for hydrogen. The interconnected escape channels can also be observed in both a polished, and a polished and etched cross section of the coating.

These interconnected escape channels have been identified in zinc-nickel coatings on high strength steels. These zinc-nickel coatings have been prepared in accordance with the process set forth in the prior copending application identified above, expressly incorporated herein by reference. Steel articles coated with the zinc-nickel alloy in accordance with procedures set forth in that application exhibit excellent low hydrogen embrittlement characteristics as well as the desired corrosion resistance. Likewise, the presence of interconnected escape channels as defined herein and as illustrated in the accompanying figures will yield a steel article that exhibits low hydrogen embrittlement regardless of the composition of the coating. That is, whether the interconnected escape channels are present in a cadmium coating, in a cadmium-titanium coating, a zinc-nickel coating, or a coating comprised of other materials, the escape channels will allow the hydrogen to depart from the coated substrate during heat treatment, and thus lend low hydrogen embrittlement characteristics to the coated article.

The interconnected escape channels often are more visible in a magnified view of a polished and chemically etched cross section of the coating. Polished and chemically etched cross sections are again prepared in accordance with standard metallurgical testing procedures. A typical chemical etching solution for zinc-nickel alloys and zinc deposits is an aqueous sulfuric acid and potassium dichromate solution. Cadmium and cadmium-titanium coatings, after being polished, are typically eteched in an aqueous solution of ferric chloride and hydrochloric acid. The etching times are generally on the order of a few seconds. The interconnecting escape channels are manifested in both polished and chemically etched cross sections by a plurality of laterally interconnected lines extending from the substrate to the outer surface of the coating. These lines are actually escape channels or voids that are exposed on the surface of the cross section. While a greater number of interconnected escape channels will enhance the low hydrogen embrittlement characteristics of a coated article, it has been found that the presence of too large a number of interconnected escape channels will unfavorably lower the corrosion resistance of the coated article, the main goal in placing the coating on the article in the first place. Thus, it is preferred that the area of escape channels exposed on the surface of a polished or polished and etched cross section of the coating comprise only up to about 25 percent of the surface area of the cross section. Moreover, it is preferred that the area of the escape channels exposed on the surface of such cross section be no less than about 4 percent of the total surface area of the cross section of the coating. If this lower limit is not achieved, there will be an insufficient number of channels to adequately allow hydrogen to escape and thus provide low hydrogen embrittlement characteristics.

Other microstructural features of coatings that are associated with an article that exhibits low hydogen embrittlement are also readily discernible in a polished and chemically etched cross section. For example, it is preferred that the interconnected escape channel also be associated with a dendritic microstructure. The presence of irregular large voids and flow channels extending to the surface of the electrodeposited coating are characteristic in cadmium-titanium coatings on articles that exhibit low hydrogen embrittlement characteristics. Additionally, a coarse grained structure is apparent in both cadmium and cadmium-titanium coatings on articles that exhibit low hydrogen embrittlement.

Similarly, there are certain microstructural features that appear in a polished and etched cross section that are undesirable if a coating is to provide the coated article with low hydrogen embrittlement characteristics. Thus, the presence of small isolated voids and restricted flow channels in the electrodeposited coating are to be avoided. In the absence of these microstructural features and in the presence of interconnected escape channels, the coating will exhibit low hydrogen embrittlement. Similarly, when the coating has a banded microstructure or a uniform fine grained microstructure, the coated article will not exhibit low hydrogen embrittlement in the absence of interconnected escape channels. Specific examples of each of the features are provided below.

There are also microstructural features of a fractured cross section that are unique to a coating on an article that exhibits low hydrogen embrittlement. The fractured cross sections are prepared in accordance with standard metallurgical testing procedures. When the fractured cross sections are magnified, preferably at least on the order of 400 times their original size or greater, certain characteristic features are noted in the coating on articles that exhibit low hydrogen embrittlement. These features include a fine grained microstructure, cleavage fracture, that is, fracture that occurs along cleavage planes, and a layered microstructure. This desirable layered microstructure in the fractured cross section comprises relatively thick layers, as opposed to the undesirable banded microstructure that is exhibited by certain coatings when viewed in a polished and etched cross section. The presence of a geometric configuration in the fractured cross section, or of a radiating or straight columnar microstructure must also be avoided, as these structural features will most clearly provide a coated article that will exhibit unacceptably high hydrogen embrittlement.

Also, the coating on a coated article exhibiting low hydrogen embrittlement in accordance with the present invention embodies a unique grain size when viewed in fractured cross section. While the term grain in utilized herein, it is intended to encompass what appears to be grains or grain-like microstructural features that are exposed in a fractured cross section of the coating. The grain size is determined by measuring the grains appearing in the magnified fractured cross section and averaging those to determine the mean area of a grain exposed on the photomicrograph of the fractured cross section. It has been found that a grain size ranging from 0.8 square microns up to about 150 square microns in an electrodeposited coating will provide a coated article that exhibits low hydrogen embrittlement.

It has also been determined that if the hydrogen present in the substrate after all processing has been finished exceeds a predetermined limit, the coated article will exhibit unacceptable hydrogen embrittlement characteristics. It has been determined, for example, that high strength steels, that is those having an ultimate tensile strength greater than about 200 ksi, cannot tolerate hydrogen in the substrate in amounts in excess of one part per million. Total hydrogen in both the substrate and the coating can however exceed the one part per million upper limitation.

After reviewing the foregoing array of microstructural characteristics present in a coating that will yield a coated article exhibiting low hydrogen embrittlement and those microstructural characteristics that will prevent a coated article from exhibiting low hydrogen embrittlement, one of ordinary skill will readily realize that the presence or absence of these characteristics provides a novel and unique method for determining whether a coated article will exhibit low hydrogen embrittlement. Thus, the present invention also provide a means for monitoring a plating process and the quality of the resulting coated product. Whether a given coated article will exhibit low hydrogen embrittlement can be ascertained by preparing a cross-sectional specimen of a coated article, magnifying the cross section, and determining from that magnified cross section whether those characteristics that allow a coated article to exhibit the low hydrogen embrittlement are present. This determination can be confirmed by determining the absence of those characteristics that will prevent the article from exhibiting low hydrogen embrittlement. For example, observing the presence of interconnected escape channels in a polished or polished and etched cross section will lead to the conclusion that the coated article will exhibit low hydrogen embrittlement. On the other hand, the presence of a banded structure or uniform fine grain structure in a polished and chemically etched cross section of the coating will lead to the opposite conclusion. In addition, when the desired microstructure is present, analyzing for the amount of hydrogen in the substrate will enable one to determine whether or not the coated article has been properly heat treated at an elevated temperature.

EXAMPLES

The following examples are intended to teach one of ordinary skill how to make and use the invention disclosed herein. They are not intended in any way to limit the scope of protection granted in the Letters Patent issued hereon. The following examples are illustrative of various plating procedures to plate metallic coatings on steel substrates. While only high strength steel substrates are employed, it is to be understood that low strength steels as well as other metallic substrates can be employed while still achieving the desired results in accordance with the present invention. All electroplating baths are prepared using technical grade materials and tap water. Unless otherwise stated, all percentages are by weight. All of the materials plated in the following examples are plated by electrodeposition techniques. The plating baths were not agitated. Any pH adjustments referenced were made as necessary by utilizing suitable acids or ammonium hydroxide. Hydrogen in the substrate and in the plated coating was determined using the methods set forth in "An Ultrasensitive Hydrogen Detector," K.B. Das, Special Technical Publication 543, ASTM 1974.

The top surface view and the fractured, polished, and polished and etched cross sections were magnified and viewed with the aid of a scanning electron microscope. The photomicrographs resulting are appended hereto as figures and are correlated to the various materials produced in accordance with the following examples. Notch tensile specimens are prepared from 4340 steel (260 to 280 ksi ultimate tensile strength). Notch tensile specimens are tested for low hydrogen embrittlement in accordance with ASMT F-519, type Ia. The specimens are tested by static tensile loading at 75 percent of established notch ultimate tensile stregnth (UTS). The specimens are loaded continuously for at least 150 hours or until failure. The specimens that withstand the loading for more than 150 hours exhibit satisfactory low hydrogen embrittlement characteristics. Grain size estimates were conducted with a Videoplan machine manufactured and commercially available from Carl Zeiss, Inc., 444—5th Avenue, New York, N.Y. The Videoplan machine employs a computerized image analysis and expresses in square microns the average area of the grains or grain-like structures exposed on the surface of a fractured cross section as the mean image area.

EXAMPLE 1

An aqueous zinc-nickel electroplating bath contains per liter of solution 19 grams of zinc oxide, 38 milliliters of hydrochloric acid (38%HCl), 28 grams of nickel chloride hexahydrate, 180 grams of ammonium chloride, 20 grams of boric acid, and approximately 20 milliliters of ammonium hydroxide (29% ammonia). Additionally, 2.25 grams per liter of a nonionic surfactant and 0.75 grams per liter of an anionic surfactant were present in the bath. The nonionic surfactant employed was "Igepal CO 730," which is commerically available from GAF Corporation. The nonionic surfactant is an ethoxylated nonyl phenol having approximately 15 repeating ethyleneoxy groups in the hydrophylic portion of each molecule. The anionic surfactant employed was "Duponol ME Dry," which is commerically available from E.I. du Pont de Nemours and Company, Inc. The anionic surfactant is a sodium lauryl sulfate. The pH of the bath was 6.3. During plating the temperature of the bath was maintained at 24°C. The weight ratio of nickel ion to zinc ion was 0.4 to 1.

A notch tensile specimen (identified as A-0206) was manufactured in accordance with the standard set forth above. This specimen along with other specimens were plated in the bath. Two nickel and two zinc rods having similar area were used as anodes and arranged symmetrically about the specimens during plating. A selected specimen was plated at a current density of 2.0 amperes per square decimeter for a period of 15 minutes. After plating, the specimen was chromated and baked (heat treated) for 12 hours at 190° C. The specimen can be baked as desired before or after chromating. The purpose of the heat treatment step is to drive hydrogen from the surface of the substrate out through the plated coating. After baking, the specimen passed the low hydrogen embrittlement test by withstanding loading for 200 hours.

FIGS. 1, 2, 3 and 4 are respectively photomicrographs magnified to 5000× of the top surface, a fractured cross section, a polished cross section, and a polished and etched cross section, respectively, of the specimen. The fractured cross section has a fine grained appearance. When measured by the Videoplan machine, a mean image area of 0.81 square microns was recorded. The polished and etched cross section was etched with a solution containing 2.5 milliliters per liter of sulfuric acid (specific gravity 1.84) and 5 grams per liter of potassium dichromate. The specimen was etched at ambient temperature for approximately 3 seconds. The interconnecting escape channels are discernible in the polished and etched cross section extending from the metal substrate at the lower portion of the photomicrograph upwardly to the surface of the coating. Lateral interconnections are also observed.

Similar zinc-nickel specimens were manufactured and identified as specimens A-3660 and A-3303. They were plated and processed in accordance with the above procedures except that the bath in which the A-3303 specimen was plated contained no surfactants. The mean image area of the grains recorded on the fractured cross section for each of the foregoing specimens were 1.66 square microns and 149.01 square microns, respectively. The presence of surfactants reduces the grain size.

EXAMPLE 2

The procedure of Example 1 was repeated with the exception that the weight ratio of nickel ion to zinc ion was changed to 1 to 1 by utilizing per liter of solution 15 grams of zinc oxide, 30 milliliters of hydrochloric acid, and 49 grams of nickel chloride instead of the amounts set forth in Example 1. A notch tensile specimen (1569E) was plated at 2.0 amperes per square decimeter for 15 minutes. After baking, the specimen passed the LHE test by withstanding the loading for 200 hours.

Figure 5:
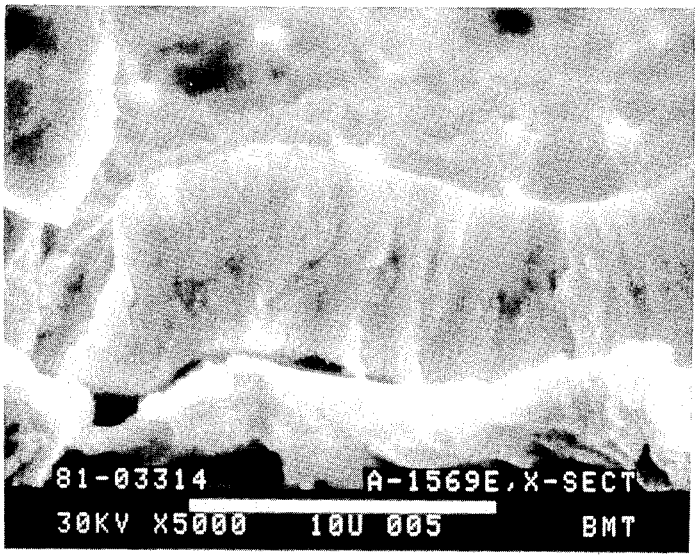

FIG. 5 is a photomicrograph of a fractured cross section of the specimen. Cleavage fracture is evident. Although not readily identifiable, the specimen also appears to be fine grained.

EXAMPLE 3

Another aqueous zinc-nickel electroplating bath contained per liter of solution, 19 grams of zinc oxide, 38 milliliters of hydrochloric acid, 28 grams of nickel chloride hexahydrate, 180 grams of ammonium chloride, 20 grams of boric acid and approximately 20 milliliters of ammonium hydroxide. The bath also contained 2.25 grams per liter of Igepal CO 730 and 0.75 grams per liter of Duponol ME Dry. The bath was aged for three months and electrolyzed intermittently for about 30 amperes-hours per gallon. After aging, the bath was analyzed and found to contain 4.5 grams per liter of zinc metal and 19.2 grams per liter of nickel. The weight ratio of nickel ion to zinc ion was initially 0.4 to 1 and had changed to 4.3 to 1. The pH of the bath was 6.3. A notch tensile specimen (A-0032) was plated in the bath at 2.0 amperes per square decimeter for 15 minutes. The temperature of the bath was 2420 C. during plating. After baking, the specimen passed the LHE test by withstanding loading for 200 hours.

Figure 6:
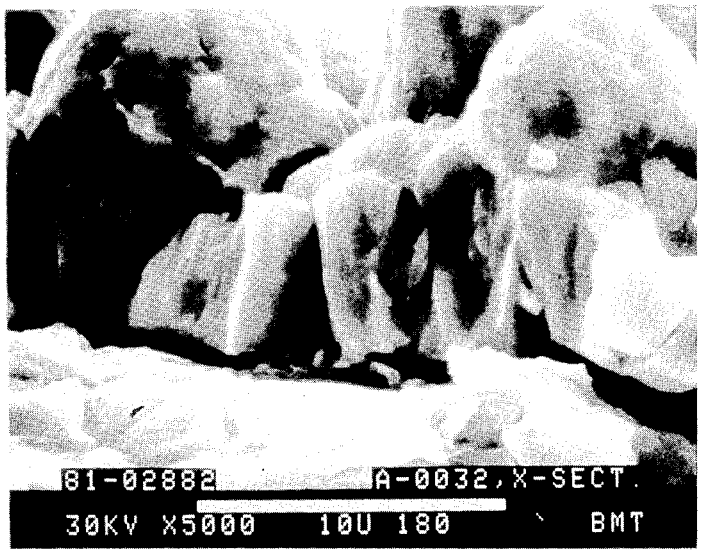
Figure 7:
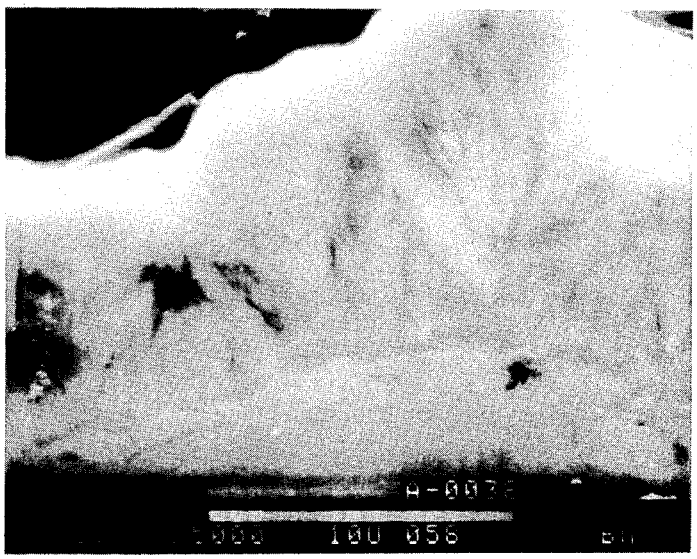
Figure 8:
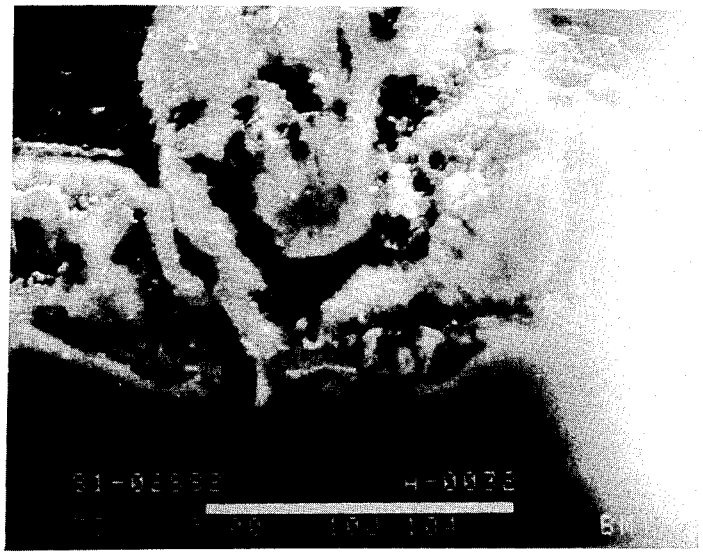

FIGS. 6, 7 and 8 are respectively photomicrographs of a fractured cross section, a polished cross section and a polished and etched cross section of the notch tensile specimen. Cleavage fracture is evident in the fractured cross section. A fine grain is also discernible. Interconnecting escape channels for hydrogen can be observed in both the polished and polished and etched cross sections, but they are more evident in the polished and etched cross section. The interconnecting escape channels extend from the surface of the substrate to the surface of the coating. Their interconnecting structure is readily apparent.

The same specimen was tested for hydrogen levels in the substrate and the plated coating in accordance with the procedure set forth above. The substrate was found to contain 0.8999 ppm of hydrogen while the coating contained 3.7055 ppm for a total of 4,6054 ppm of hydrogen.

EXAMPLE 4

Figure 9:
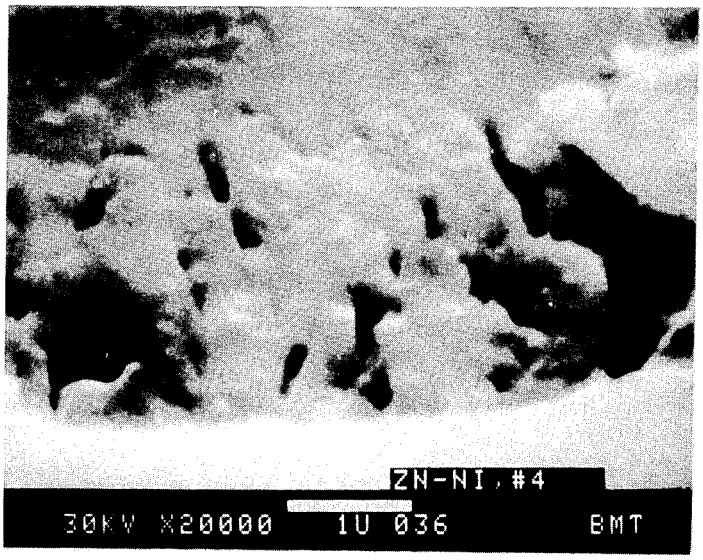

The procedure of Example 1 was repeated with the exception that the Igepal and Duponol surfactants were absent from the bath. Steel (1020) panels (4"×6") were plated at 2.0 amperes per square decimeter for approximately 4 hours. The panels were cross sectioned, polished and etched. FIG. 9 is a photomicrograph of a first specimen identified as "Zn-Ni#4" magnified 20,000×. The interconnecting escape channels are barely visible. The Videoplan machine was utilized to survey and calculate the area of the escape channels exposed on the surface of the polished cross section. The percentage of exposed channels was found to be about 8.2 percent of the total area of the coating exposed on the cross section.

Figure 10:
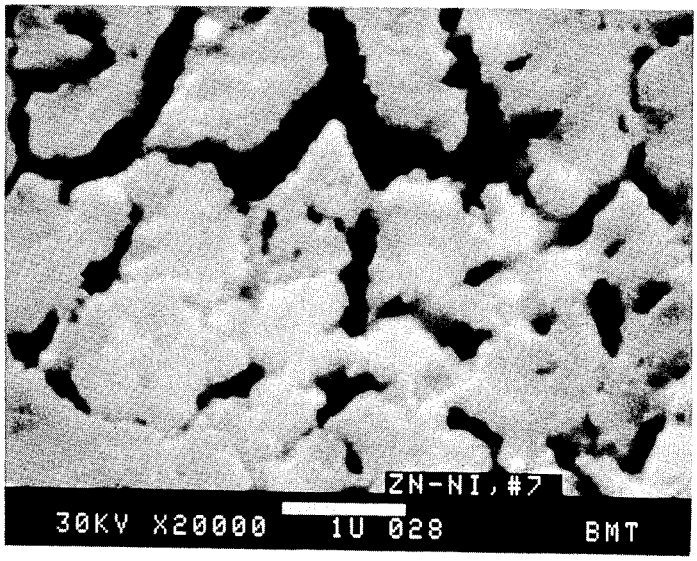
Figure 11:
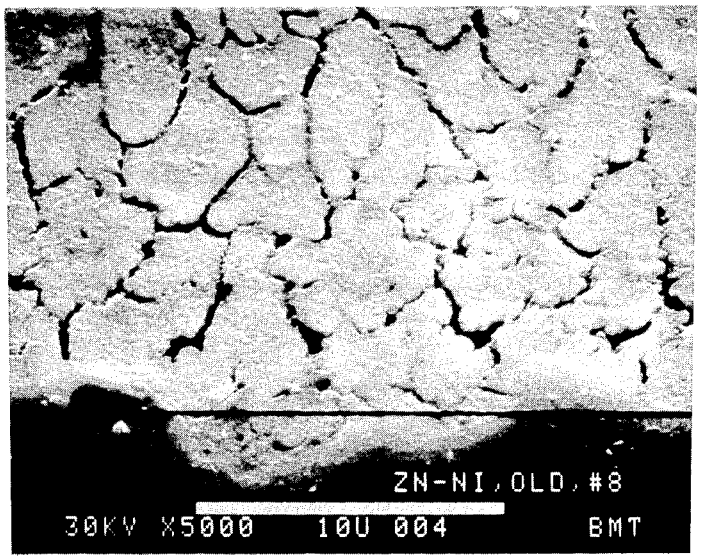

A second specimen identified as "Zn-Ni#7" was plated in a similar bath containing the two surfactants. A cross section of the specimen is shown in the photomicrograph of FIG. 10 magnified to 20,000×. The interconnected escape channels are clearly observed in FIG. 10. The area of excape channels exposed on the surface of the cross section is 18.9 percent of the total coating exposed on the cross section. This increase in the area of escape channels is attributable to the presence of the surfactants in the plating bath. A third specimen identified as "Zn-Ni#8" was prepared using the bath containing surfactants. The escape channels are clearly visible in the photomicrograph of FIG. 11.

Figure 12:
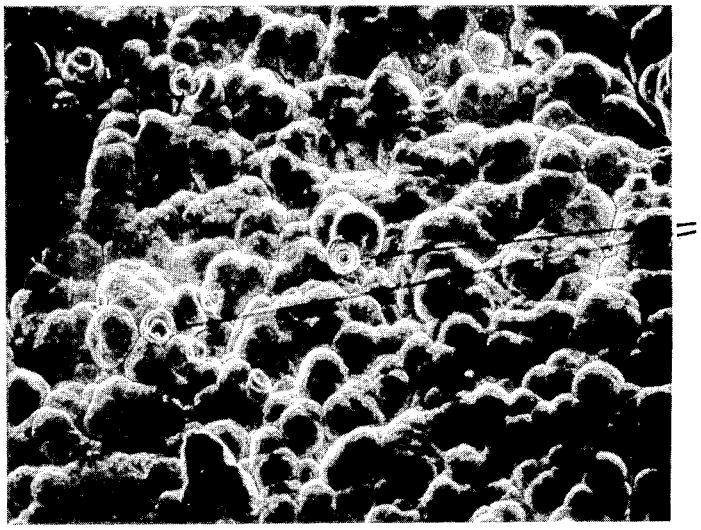
Figure 13:
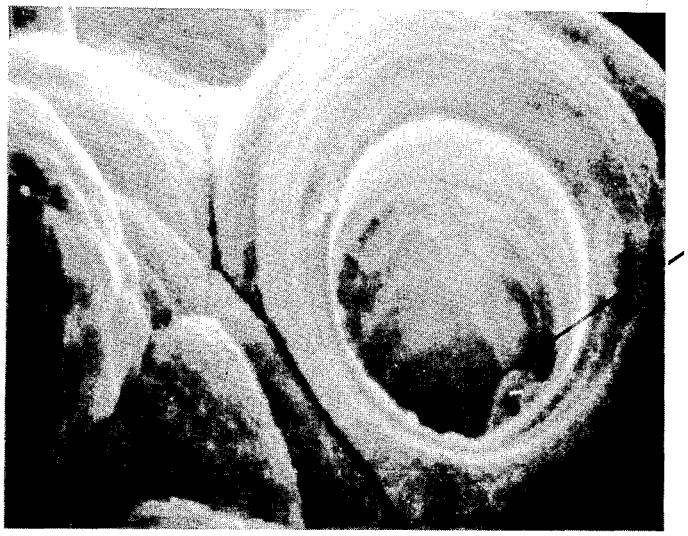

FIGS. 12 and 13 are photomicrographs at 400× and 5000×, respectively, of the tops of one of the surface panels plated in accordance with the procedure of this example. Circular openings are observed at the terminus of the lead lines superimposed on the figures. These are believed to be openings from the interconnecting escape channels onto the surface of the coating.

EXAMPLE 5

A notch tensile specimen of a high strength steel (A-3634) was plated in a cadmium-titanium alloy plating bath. The bath is of the type commerically used to produce corrosion resistant high strength steels that have low hydrogen embrittlement characteristics. The bath container per liter of solution 25 grams of cadmium metal, 123 per liter of cyanide (as sodium cyanide), 17 grams per liter of sodium hydroxide, 47 grams per liter of sodium carbonate and 73 parts per million of titanium metal. The specimen was plated at a current density of 2.0 amperes per square decimeter for 15 minutes. the bath was maintained at a temperture of 20° C. during plating. The plated deposite contained about 0.36 percent titanium with the balance being cadmium. The specimen was baked in accordance with conventional procedures and tested for LHE characteristics. It passed the LHE test after being loaded for 200 hours. The hydrogen content of the substrate and the coating was measured and found to be 0.7248 ppm and 2.0138 ppm, respectively, giving a total hydrogen content of 2.7386 ppm.

Figure 14:
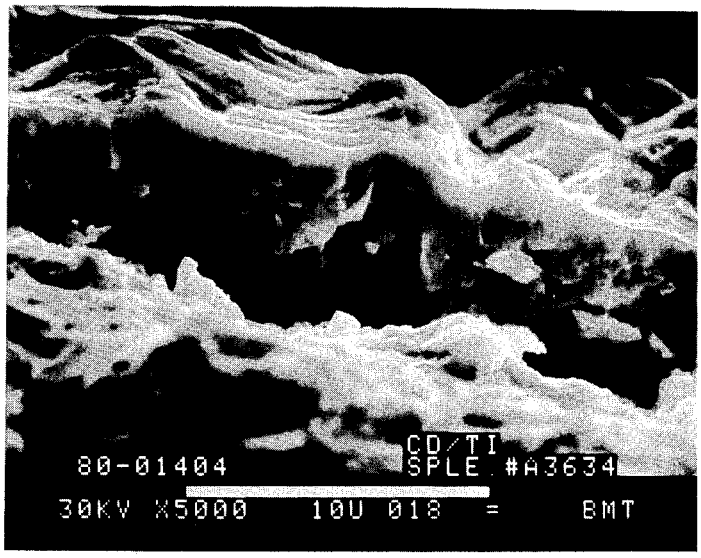
Figure 15:
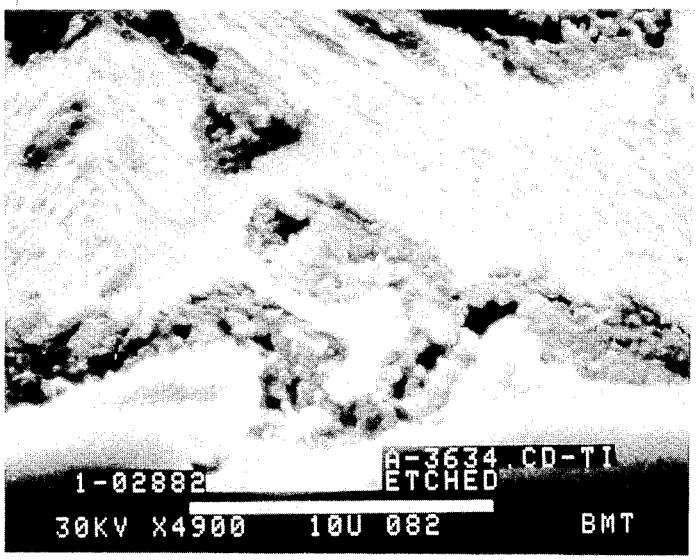
Figure 35:
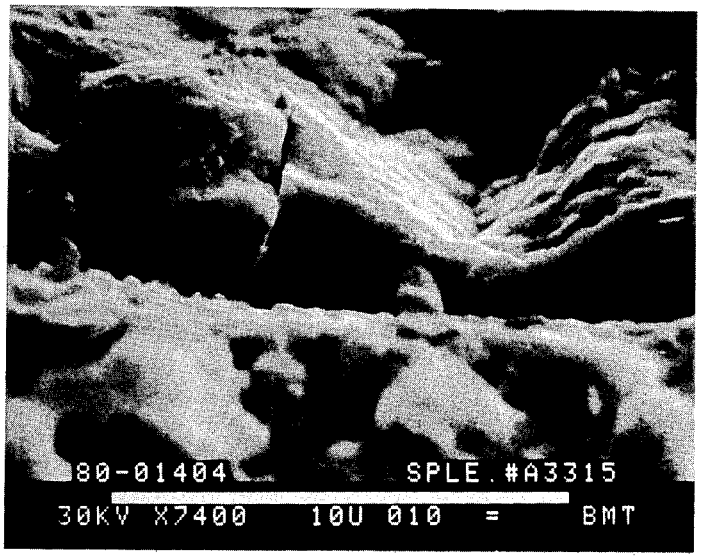

FIG. 14 is a photomicrograph of a fractured cross section of the specimen, while FIG. 15 is a photomicrograph of the polished and etched cross section. Both photomicrographs are at a magnification of 5000×. As is readily observed, the fractured cross section shows a layered structure. This structure can similarly be found in zinc-nickel coatings on high strength steel having low hydrogen embrittlement. See, for example, the layered structure of FIG. 35, which is a photomicrograph of a Zi-Ni coating prepared in accordance with the procedure of Example 1, but omitting the surfactants. Irregularly shaped large voids and flow channels can be discerned in the polished and etched cross section. While this structure is different from the interconnected escape channels exemplified in the zinc-nickel microstructure, the layered fractured cross section and the irregular large voids and flow channels in the polished and etched cross section are indicative of a coating that allows the underlying substrate to exhibit low hydrogen embrittlement.

EXAMPLE 6

An aqueous dull cadmium electroplating bath was prepared in accordance with ASTM standard F-519, Annex, Table A1, Treatment B. The bath contained per liter of solution, 33,7 grams of cadmium oxide and 104 grams of sodium cyanide. A notch tensile specimen (A-1544) was plated at 6.0 amperes per square decimeter for 6 minutes at a temperature of 24° C. After plating, the specimen was baked for 23 hours. The specimen passed the LHE test after being loaded for 200 hours, despite having a hydrogen content in the substrate of 2,2152.

Figure 16:
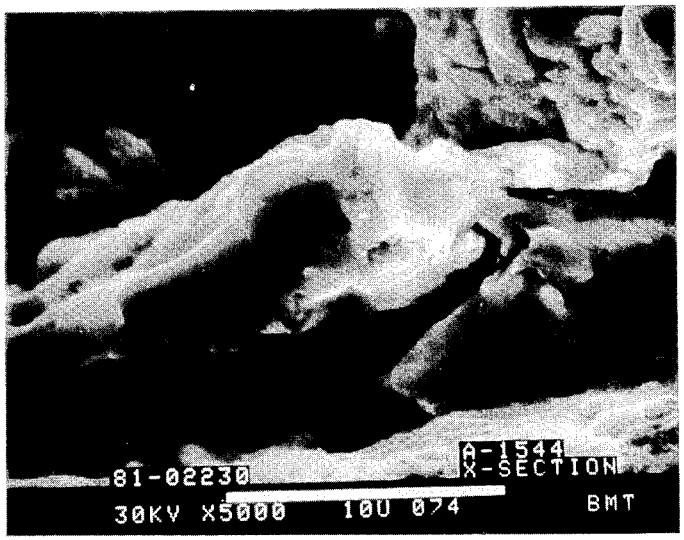
Figure 17:
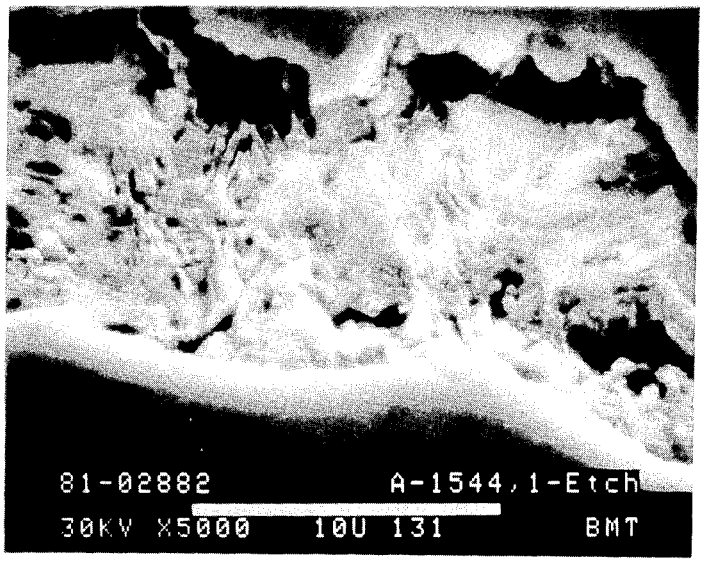

FIG. 16 is a photomicrograph of a fractured cross section of the specimen while FIG. 17 is a photomicrograph of a polished and etched cross section. Both photomicrographs are at a magnification of 5000×. A layered microstructure similar to that in the previous example is observed in the fractured cross section, while irregular large voids are discernible in the polished and etched cross section.

EXAMPLE 7

A bright cadmium plating bath of the type utilized to produce commercial corrosion resistant steel parts was prepared. The bath container per liter of solution, 26 grams of cadmium, 104 grams of cyanide (as sodium cyanide), 19 grams of sodium hydroxide, and 47 grams of sodium carbonate. A proprietary brightener, Rohco "Super XL" brightener from the R. O. Hull Company was added to the bath. Initially, 0.75 percent by volume of the brightener was added. The notch tensile specimen (A-1706) was plated at an average current density of 2.0 amperes per square decimeter for 17 minutes. The bath temperature was maintained at 24° C. After plating, the specimen was baked for 3 hours at 190° C. It passed the LHE test after being loaded for 200 hours. The hydrogen content of the substrate and coating was 0.6821 ppm and 2.9080 ppm, respectively. One would expect the specimen to pass because the substrate hydrogen content was less than one ppm, even though the total hydrogen content in the substrate and coating exceeded one ppm.

Figure 18:
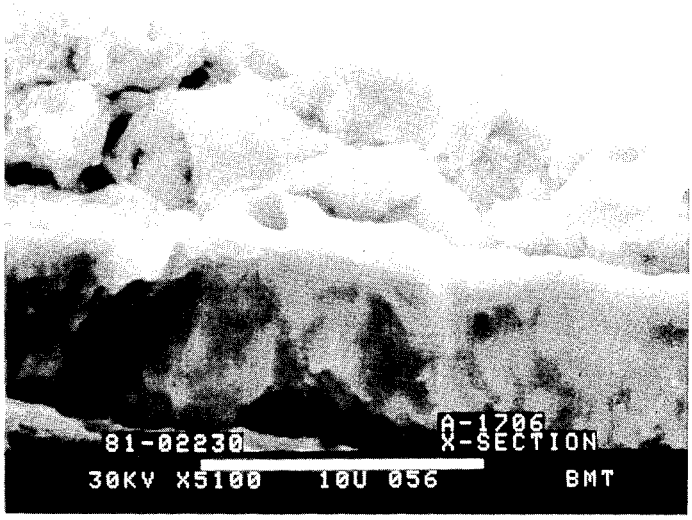

FIG. 18 is a photomicrograph of a fractured cross section of the specimen. The magnification is 5000×. A layered microstructure is clearly discernible.

EXAMPLE 8

An aqueous zinc-nickel electroplating bath was prepared. It contained per liter of solution 47 grams of zinc chloride, 61 grams of nickel chloride hexahydrate, 250 grams of ammonium chloride and 20 grams of boric acid. The pH of the bath was adjusted from 3.8 to 5.9 by the addition of an appropriate amount of ammonium hydroxide. The bath temperature during plating was maintained at about 24° C. The weight ratio of nickel ions to zinc ions in the bath was 0.67 to 1. A notch tensile specimen (A-3158) was plated at a current density of 2.0 amperes per square decimater for 30 minutes. The specimen was baked. The specimen failed the LHE test after 36.5 hours of loading because the hydrogen content in the substrate was 5.8989 ppm.

Figure 20:
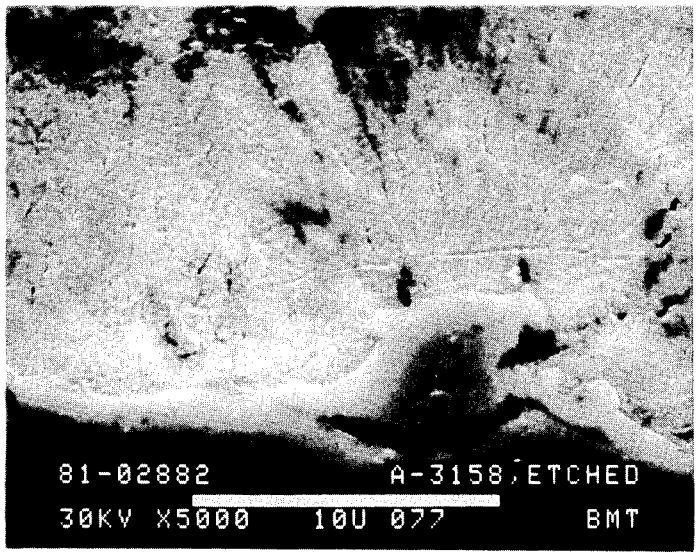

FIG. 91 is a photomicrograph of a fractured cross section of the notch tensile specimen, while FIG. 20 is a photomicrograph of a polished and etched cross section of the specimen, both magnified 5000×. The microstructure of the fractured cross section exhibits a geometric configuration while isolated voids and restricted flow channels can be observed in the polished and etched cross section. These microstructures indicate that a coating having these microstructural characteristics will not provide an enviroment that will allow a coated substrate to exhibit low hydrogen embrittlement.

Figure 21:
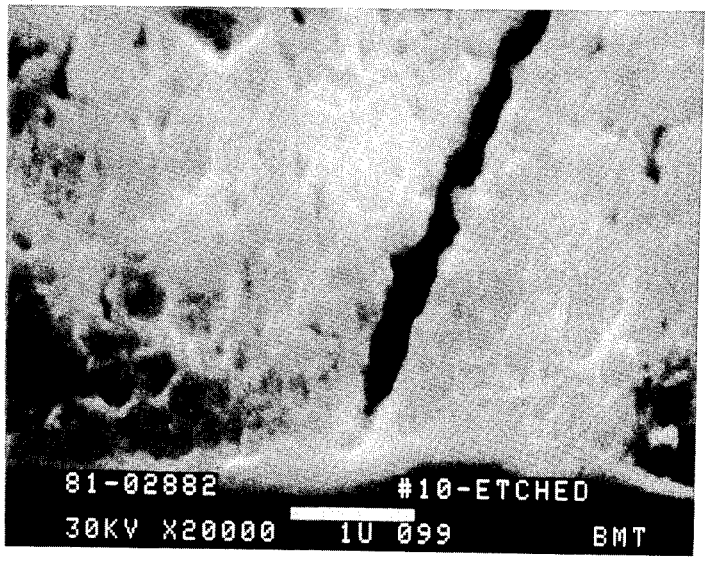

A 1020 steel panel (4 "×6") was plated in the same plating bath. It was plated at a current density of 2.0 amperes per square decimeter for approximately 4 hours. FIG. 21 is a polished and etched cross section of the coating magnified to 20,000×. Isolated small voids can be observed in the microstructure with no interconnected escape channels.

EXAMPLE 9

An aqueous zinc electroplating bath was prepared. The bath contained per liter of solution 30 grams of zinc oxide, 60 milliliters of hydrochloric acid, 180 grams of ammonium chloride and 2.25 grams "Igepal CO 730." The pH of the bath was 5.8. The temperature of the bath during plating was maintained at about 24° C. A notch tensile specimen (A-1866) was plated at an average cathode current density of 2.0 amperes per square decimeter for 15 minutes. After plating, the specimen was baked for 12 hours at 190° C. The specimen failed the LHE test after 9 hours of loading. The substrate contained 1.1078 ppm of hydrogen.

Figure 22:
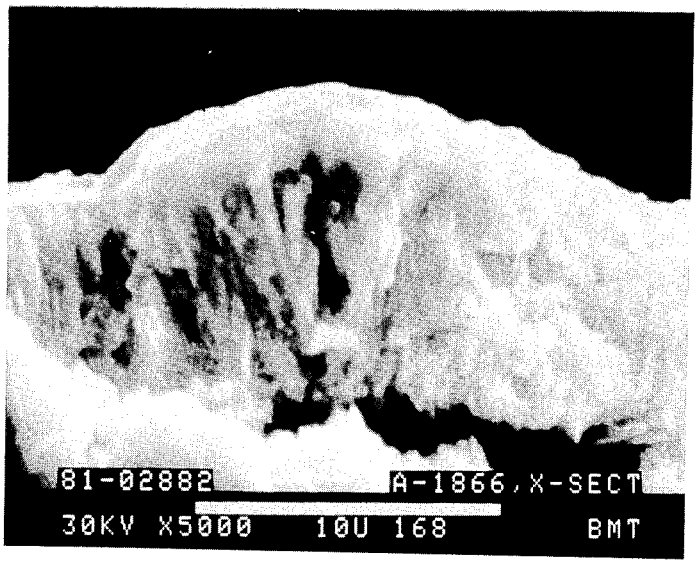
Figure 23:
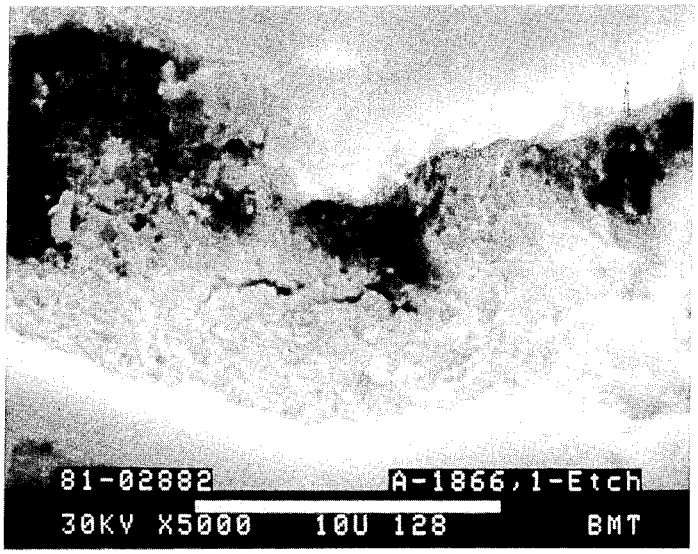

FIG. 22 is a photomicrograph of a fractured cross section of the specimen, while FIG. 23 is a photomicrograph of a polished and etched cross section. Both photomicrographs are at a magnification of 5000×. A radiating columnar microstructure is observed in FIG. 22. Small isolated voids and the absence of interconnecting escape channels are noted in the photomicrograph of FIG. 23.

EXAMPLE 10

A bright zinc plating bath of the type used for plating commercial articles was prepared. The bath contained per liter of solution, 43.5 grams of zinc, 141 grams of cyanide (as sodium cyanide) and 127 grams of sodium hydroxide. A notch tensil specimen (A-2608) was plated at an average cathode density of 3.5 amperes per square decimeter for 15 minutes. The bath temperature during plating was maintained at about 24° C. Two-tenths of a percent by volume of a brightener, "Duozinc #101" from E. I. du Point de Nemours and Company was added to the plating bath. The total sodium cyanide to zinc ratio in the bath was 2.9. After plating, the specimen was baked for 3 hours at 190° C. The specimen failed the LHE test after being loaded for 39.6 hours.

Figure 24:
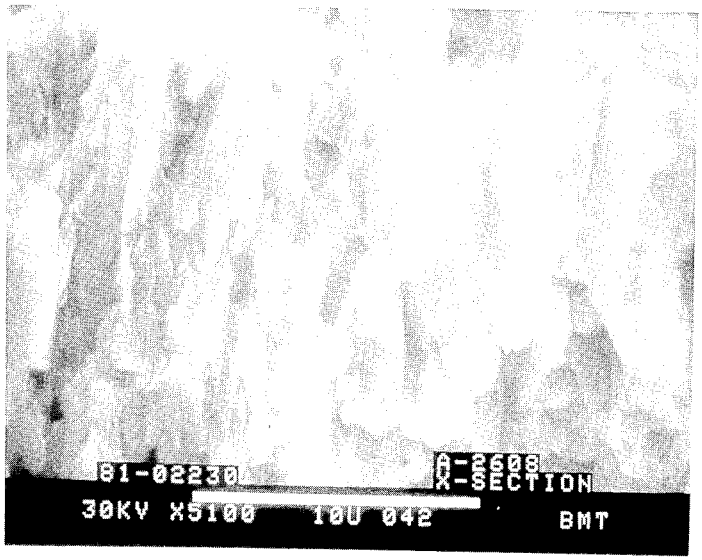
Figure 25:
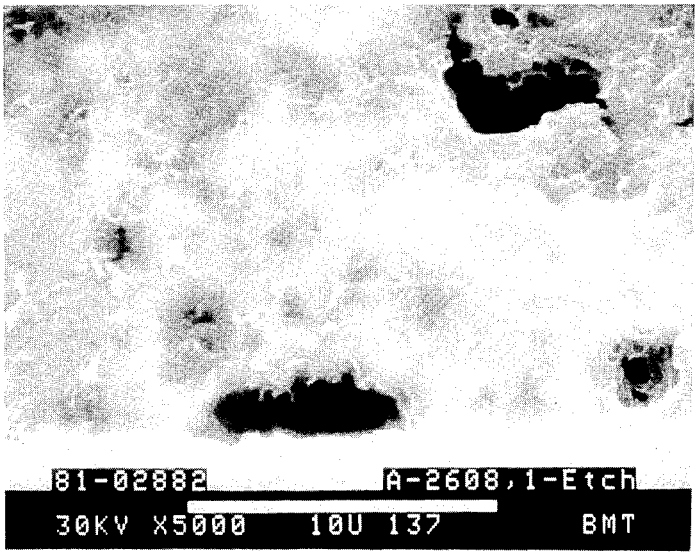

FIG. 24 is a photomicrograph of a fractured cross section of the specimen, while FIG. 25 is a photomicrograph of a polished and etched cross section of the specimen. The photomicrographs are at magnifications of 5100× and 5000×, respectively. A straight columnar microstructure is noted in the fractured cross section, while again, only small isolated voids can be observed in the polished and etched cross section. Both of these microstructures indicate that the coating will not provide a coated article with low hydrogen embrittlement characteristics.

EXAMPLE 11

A bright cadmium electroplating bath was prepared in accordance with the procedure set forth in Example 6. In addition, 15 grams per liter of solution of a brightening agent, "Rohco 20 XL" brightener from the R.O. Hull Company was added. A notch tensile specimen (A-1258) was plated in the bath at an average current density of 1.0 amperes per square decimeter for 30 minutes. The bath was maintained at a temperature of 24° C. during plating. After plating, the specimen was baked for 23 hours at 190° C. The specimen failed the LHE test after 5.5 hours of loading. The substrate and the coating contained 2.1145 ppm of hydrogen and 0.5135 ppm of hydrogen, respectively. One would have expected the specimen to fail because the hydrogen content in the substrate exceeded one ppm.

Figure 26:
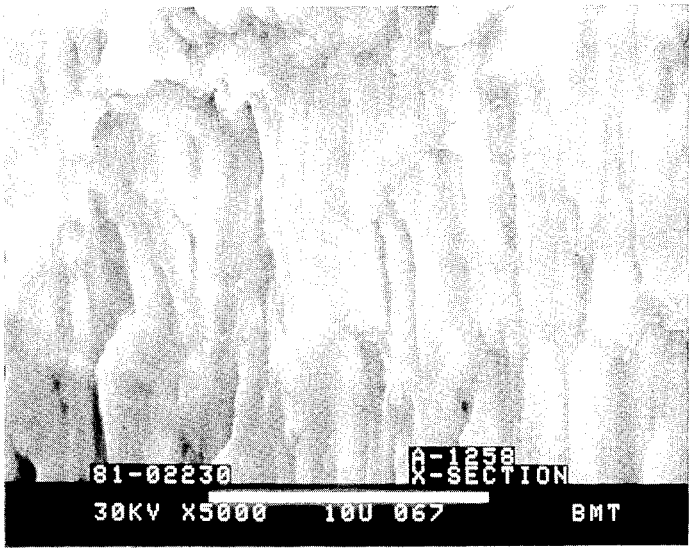
Figure 27:
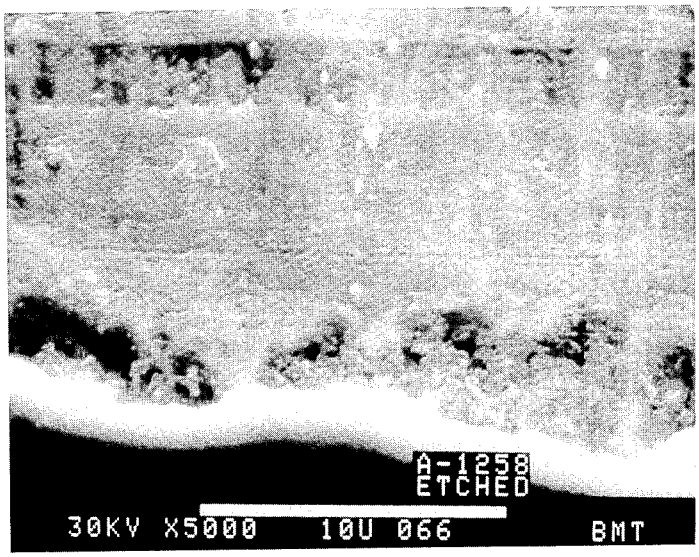

FIG. 26 is a photomicrograph of a fractured cross section of the specimen, while FIG. 27 is a polished and etched cross section of the specimen. Both photomicrographs are at a magnification of 5000×. Similarly to Example 10, the fractured cross section exhibits a straight columnar microstructure, while only small isolated voids can be observed in the polished and etched cross section.

EXAMPLE 12

To confirm the existence of the desirable and undesirable structures observed in the foregoing examples, several 1020 steel panels were plated in various of the foregoing electroplating baths at preselected current densities for approximately 4 hours. The current densities were approximately the same as those listed for the specimens plated in each of the examples. Cross-sectional specimens of each of the plates were polished and etched. Microphotographs were taken with a scanning electron microscope at a magnification of 400×. The results are set forth below.

Figure 28:
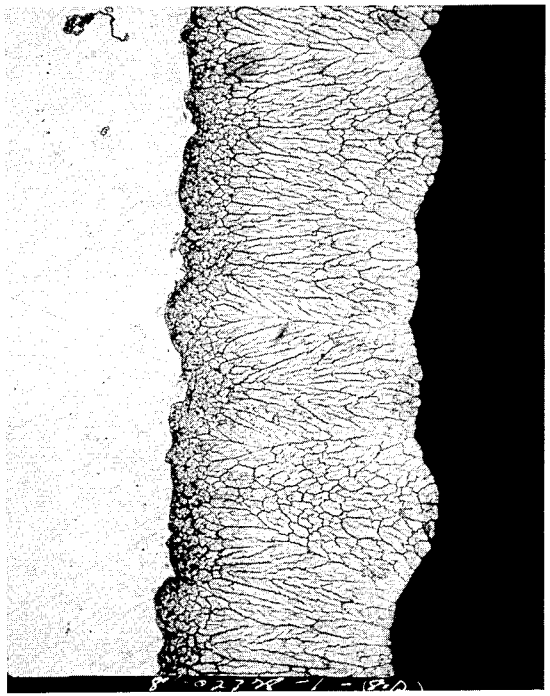
Figure 29:
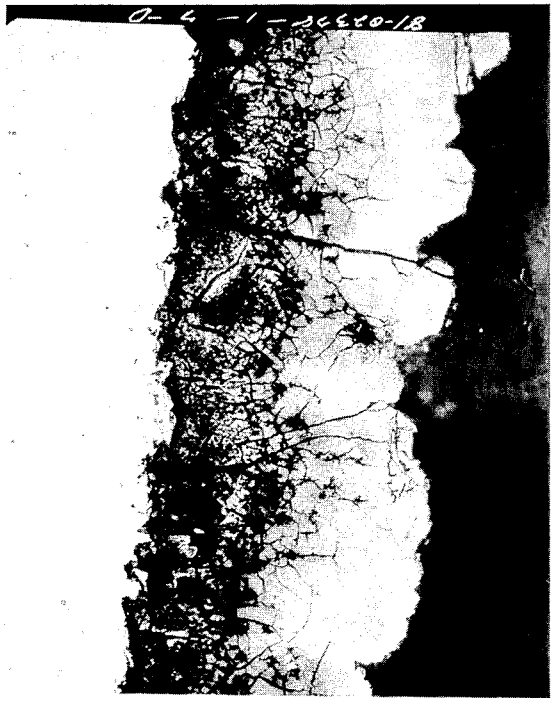

Two specimens were plated in the bath of Example 1. The photomicrographs of cross sections of these specimens are FIGS. 28 and 29, respectively. The coatings have a dendritic microstructure that indicates the presence of low hydrogen embrittlement characteristics. Interconnecting escape channels for hydrogen are clearly observed in FIGS. 28 and 29.

Figure 30:
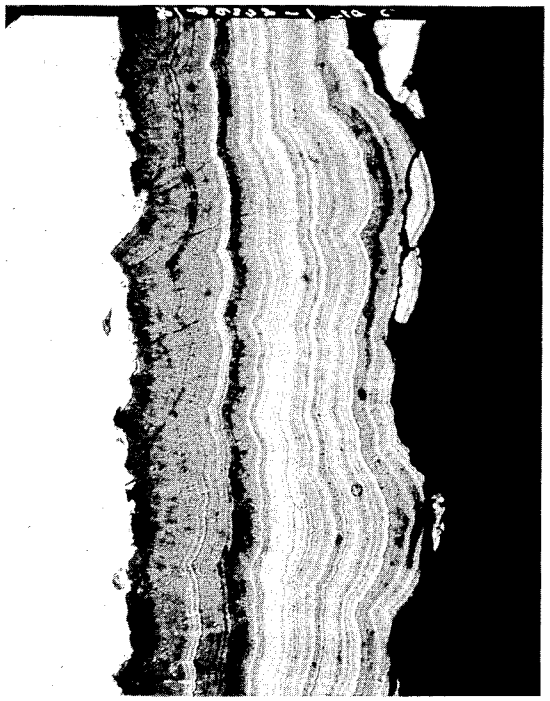

FIG. 30 is a photomicrograph of the cross section of a panel plated in the bath of Example 8. An undesirable banded microstructure is evident, which indicates the absence of low hydrogen embrittlement characteristics.

Figure 31:
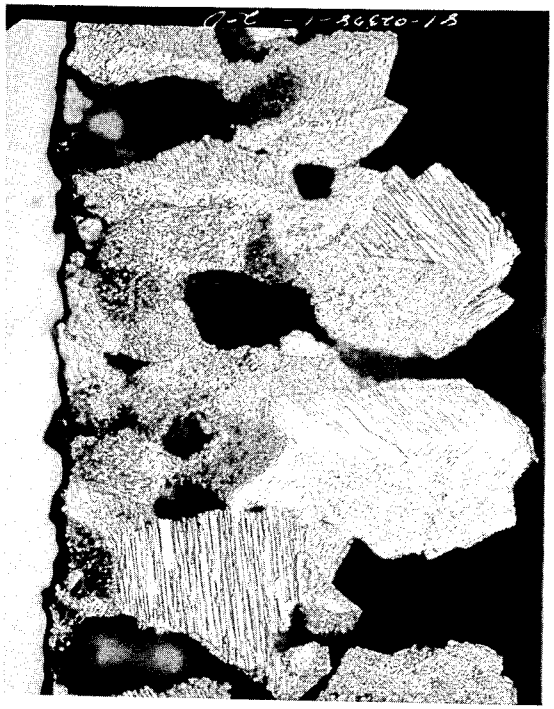
Figure 32:
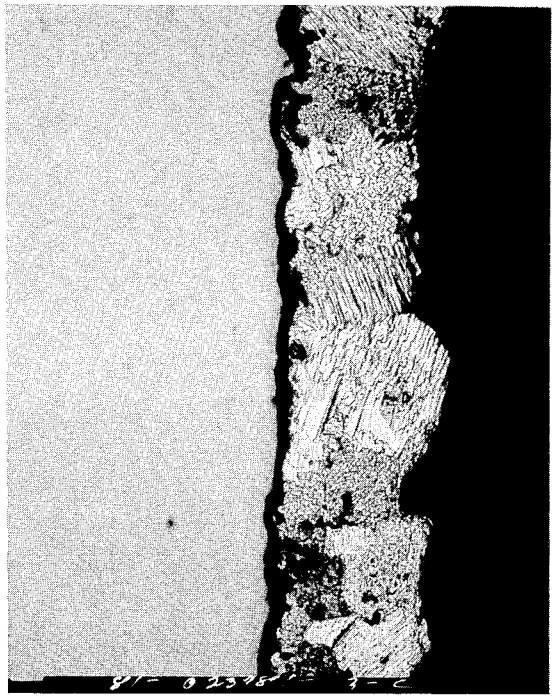

FIG. 31 is a photomicrograph of the cross section plated in the bath of Example 6. Coarse grain deposits, which indicate the presence of low hydrogen embrittlement characteristics, are observed. FIG. 32 is a photomicrograph of a cross section of a specimen plated in the bath of Example 5. A coarse grain deposit is again observed. While the bath of Examples 5 and 6 produced cadmium-titanium and a cadmium coating, respectively, these coatings do exhibit low hydrogen embrittlement characteristics.

Figure 33:
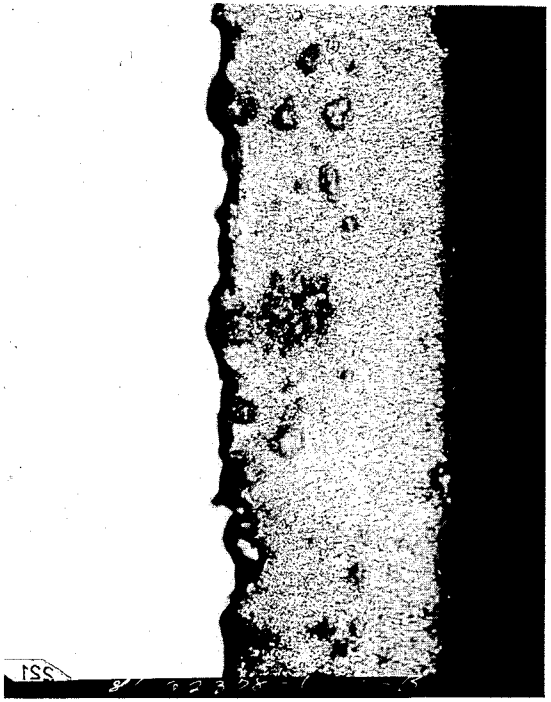
Figure 34:
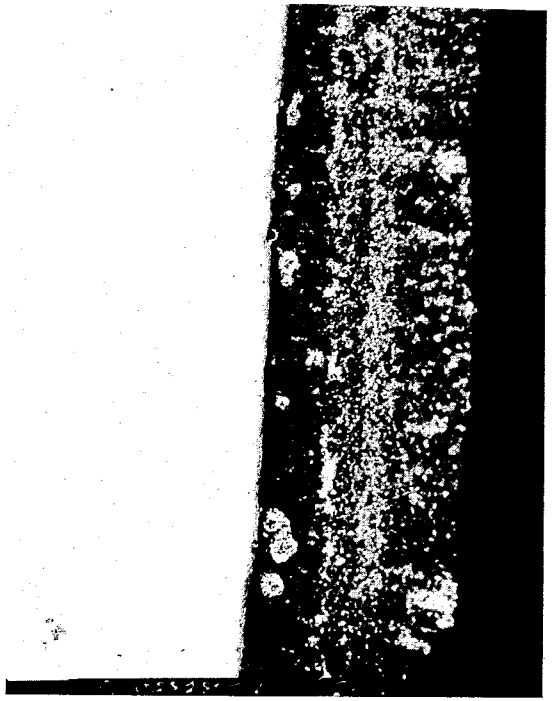

FIG. 33 is a photomicrograph of a coating plating in the bath of Example 11. FIG. 34 is a photomicrograph of a coating plated with the bath of Example 10. Both photomicrographs of the coatings display uniform fine grained deposits that are indicative of a coated article that will exhibit unacceptable hydrogen embrittlement.

While the present invention has been described in relation to preferred embodiment and variations thereof, one of ordinary skill after reading the foregoing specification will be able to effect various changes, substitutions of equivalents and other alterations without departing from the broad concepts disclosed herein. It is therefore intended that the scope of Letters Patent granted hereon be limited only the definition contained in the appended claims and equivalents thereof.

The embodiments of the invention in which an exclusive property or privilege is claimed are defined as follows:

1. A coated article exhibiting low hydrogen embrittlement and high corrosion resistance comprising:

a substrate, the amount of hydrogen present in the substrate being less than about one part per million (by weight), a metal coating comprising an alloy of zinc and nickel on said substrate having a microstructure characterized by a plurality of microscopic interconnected escape channels for hydrogen.

2. The article of claim 1 wherein the area of said escape channels exposed on the surface of a polished cross section of said coating comprises up to about 25% of the surface of said cross section.

3. The metal article of claim 2 wherein said cross section is polished and chemically etched.

4. The metal article of claim 3 wherein said microstructure is characterized by a dendritic structure.

5. The metal article of claim 3 wherein said microstructure is characterized by a coarse-grained structure.

6. The metal article of claim 2 wherein the area of said escape channels exposed on the surface of a polished cross section of said coating comprises from about 4% to about 25% of said cross section.

7. The metal article of claim 3 wherein said coating is characterized by the absence of small isolated voids.

8. The metal article of claim 3 wherein said coating is further characterized by the absence of restricted flow channels to the surface of said coating.

9. The metal article of claim 3 wherein said coating is further characterized by the absence of a banded microstructure.

10. The metal article of claim 3 wherein said coating is further characterized by the absence of a uniform fine grained microstructure.

* * * * *

UNITED STATES PATENT AND TRADEMARK OFFICE

CERTIFICATE OF CORRECTION

PATENT NO. : 4,818,632

DATED : April 4, 1989

INVENTOR(S) : Hsu et al.

It is certified that error appears in the above-identified patent and that said Letters Patent is hereby corrected as shown below:

| Column | Line | |
|---|---|---|
| [56] | 18 | Under the heading OTHER PUBLICATIONS, the article "Low-Temperature . . . .", "pp. 44-49," should be --pp. 45-49,-- |
| 1 | 56 | "cadium" should be --cadmium-- |
| 2 | 7 | "resistanct" should be --resistance-- |
| 3 | 2 | "operation" should be --operative-- |
| 3 | 25 | "surface" should be --surfaces-- |
| 3 | 46 | "cross-section" should be --cross section-- |
| 5 | 46 | "clearly" should be --certainly-- |
| 6 | 16 | "provide" should be --provides-- |
| 7 | 7 | "stregnth" should be --strength-- |
| 7 | 30 | "commerically" should be --commercially-- |
| 8 | 50 | "2420C" should be --24°C-- |
| 9 | 24 | "excape" should be --escape-- |
| 9 | 43 | "commerically" should be --commercially-- |

UNITED STATES PATENT AND TRADEMARK OFFICE

CERTIFICATE OF CORRECTION

PATENT NO. : 4,818,632

DATED : April 4, 1989

INVENTOR(S) : Hsu et al.

Figure 19:
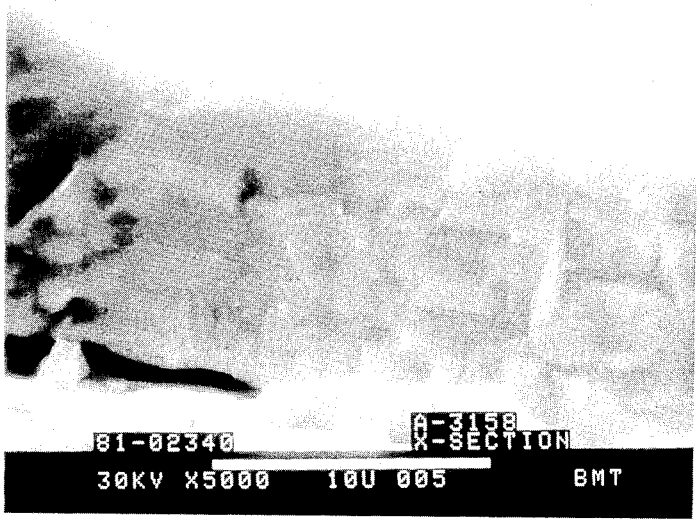

It is certified that error appears in the above-identified patent and that said Letters Patent is hereby corrected as shown below:

| Column | Line | |
|---|---|---|
| 9 | 51 | "the" should be --The-- |
| 9 | 52 | "temperture" should be --temperature-- |
| 9 | 53 | "deposite" should be --deposit-- |
| 10 | 39 | "container" should be --contained-- |
| 11 | 4 | "decimater" should be --decimeter-- |
| 11 | 8 | "FIG. 91" should be --FIG. 19-- |
| 11 | 55 | "tensil" should be --tensile-- |
| 12 | 67 | "plating" should be --plated-- |
| 13 | 6 | "embodiment" should be --embodiments-- |
| 13 | 12 | after "only" insert --by-- |

Signed and Sealed this

Ninth Day of April, 1991

*Attest:*

HARRY F. MANBECK, JR.

*Attesting Officer*

*Commissioner of Patents and Trademarks*